United States Patent [19]

Jones et al.

[11] Patent Number: 4,951,030

[45] Date of Patent: Aug. 21, 1990

[54] MONITORING SYSTEM

[75] Inventors: Gregory L. Jones, Madison County; Lance F. Jones; Peter F. Watson, both of Jefferson County, all of Ala.

[73] Assignee: Arbor Systems, Inc., Huntsville, Ala.

[21] Appl. No.: 332,627

[22] Filed: Apr. 2, 1989

[51] Int. Cl.[5] ..... G08B 21/00

[52] U.S. Cl. ..... 340/677; 340/661

[58] Field of Search ..... 340/677, 661; 200/61.18; 66/163; 28/187; 19/0.25; 57/81; 226/11-12, 45; 242/36, 37 R; 139/336; 73/160

[56] References Cited

U.S. PATENT DOCUMENTS

| | | | |
|---|---|---|---|
| 3,911,969 | 10/1975 | Rydborn | 340/677 X |
| 4,086,575 | 4/1978 | Rydborn | 28/187 X |
| 4,361,777 | 11/1982 | Mettler | 200/61.18 X |
| 4,455,549 | 6/1984 | Rydborn | 340/677 X |
| 4,635,046 | 1/1987 | Graham | 340/677 |
| 4,695,830 | 9/1987 | Graham | 340/677 |

*Primary Examiner*—Joseph A. Orsino
*Assistant Examiner*—Thomas J. Mullen, Jr.
*Attorney, Agent, or Firm*—Phillips & Beumer

[57] ABSTRACT

A thread motion monitoring system wherein the presence or absence of thread motion for discrete threads is detected and signals developed in terms of the failure, non-thread motion, of selected numbers of threads.

19 Claims, 5 Drawing Sheets

MONITORING SYSTEM

1. FIELD OF THE INVENTION

This invention relates to a system for detecting any malfunctioning of thread-like elemental material being fed to devices which fabricate a composite material or articles made from such elemental material.

2. BACKGROUND OF THE INVENTION

Many industries are involved with the use of thread-like elements including thread, twine, yarn, cables, or other thread-like elements which are combined to form a finished workpiece. Often one or more of the thread-like elements break during the combining operation and a quality workpiece is not produced. In the sock knitting industry, for example, sets of a plurality of threads each are fed to a knitting machine to produce the sock. One set, comprising several threads, is employed to make up the upper section of the sock, this being effected at one time, and another set of threads is employed to make up the foot section of the sock, this operation properly occurring at a preceding or following time. If one thread of the plurality of threads that goes to the foot portion, for example, is broken, and if the machine is allowed to continue to run, a sock which is imperfect will result. This is true also for the top portion. Further, if both operations are attempted at the same time, this should be noted and indicated.

Applicants are aware of at least one system wherein, by means of microswitches related to each thread or thread-like element to be run, there can be signalled the specific threads that are to be run; and then by the detection of threads actually running, an error condition may be detected. However, where the same number of threads are running but different threads (threads of another color) are running, which is the common practice in the fabrication of clothing such as socks, as at different stages of production of a sock, such a system would indicate an error where none existed.

Accordingly, it is an object of this invention to provide an error detection system or monitor which overcomes the "different thread" problem and indicates an error state only when the number of threads running is an error.

It is a further object of the present invention, therefore, to provide a monitoring system which will continuously monitor and will enable warnings and/or rapid, automatic shutoff of an apparatus used in combining thread or thread-like elements which go into producing a finished product when a faulty operation is detected.

It is another object of the present invention to provide such a monitoring system which will indicate the operational state of movement of discrete thread-like elements.

It is yet a still further object of the present invention to provide such a system for the prevention of the production of imperfect socks.

SUMMARY OF THE INVENTION

In accordance with this invention, each sensor in a group of thread motion sensors provides a discrete electrical output responsive to the presence or absence of the detected thread running or motion state. The outputs of each in the group are then combined such that the number of threads running is signalled. This is then compared with the standard or standards for the number that should be running and correctness or incorrectness indicated. Further, upon the indication of incorrectness, the indicators of all sensors are frozen, whereby the one indicating a faulty state may be quickly located. Further, means are provided to make available an error state output upon sustained thread non-motion for a discrete period to ensure against false alarms. Still further, an error state output is provided in the form of a pulsed output for the remote indication and control of external equipment, as, for example, of a knitting machine to which monitored threads are fed. Still further, several monitors may be employed, each monitoring a discrete group of thread motion sensors, and wherein outputs of the monitors may be cross-correlated and error outputs of one predicated upon the discrete failure of a thread monitored by a single monitor absent a thread running signal from another monitor. Finally, means are provided to monitor when either or both monitors of a pair of monitors indicate at least one thread in motion and for the reset of the system following a detected error state and correction of it.

DESCRIPTION OF THE PREFERRED EMBODIMENT

Figure 1:
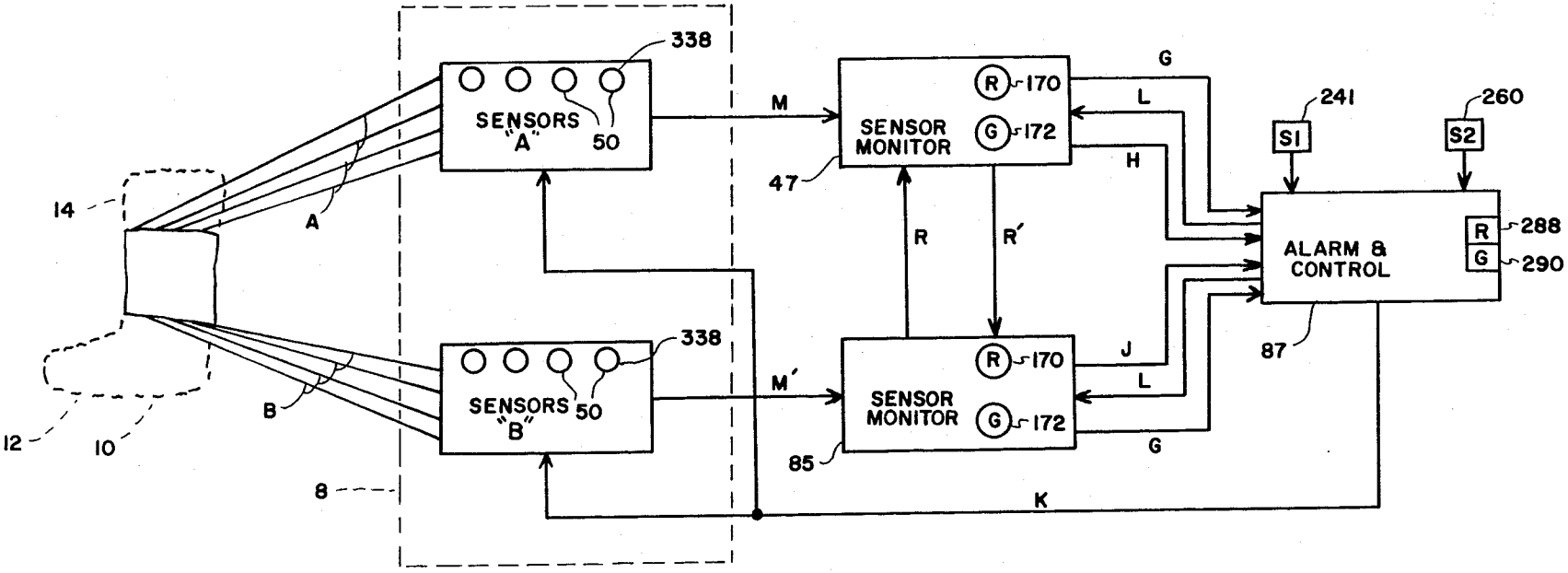
FIG. 1 is a diagrammatic illustration of an embodiment of the present invention in which the principles of the invention are utilized in controlling the operation of a knitting machine.

FIG. 1 illustrates the general system of the present invention and the sub-systems which form it. The system is illustrated in its application to a knitting machine 8 as employed to knit a sock 10. The knitting process is divided into two operations, operation 1 being the knitting of the foot portion 12 of the sock, and operation 2 being the knitting of the upper portion 14 of the sock. These operations, while being obviously related, are separately performed, one operation being performed at a time. It is assumed that one set of threads B, for example, four threads, are employed to knit the foot, and another set of four threads A are employed to knit the top.

Each of a plurality of sensors, for example, one of four sensors of sensors A, employs a yarn guide 16 (FIGS. 2*a* and 5) which is connected to a piezoelectric crystal 18, the latter generating a voltage responsive to vibration whenever there is movement of a thread through the yarn guide. This voltage is amplified, rectified, and detected as to amplitude to thus provide a discrete signal when a thread is actually moving through guide 16 of a sensor, and a signal light 50 positively indicates this. Each sensor also includes a latch circuit to hold on a signal light in the event of a detected operational failure.

Next, there are provided two separate monitors, monitors 47 and 85, monitor 47 monitoring as a set the outputs of all sensors A, and monitor 85 monitoring all sensors B. Alternately, only a single set of threads may need to be monitored, thus a single monitor employed. Each of monitors 47 and 85 developes two signals, a run signal indicating that at least one thread being monitored is detected as running, and a second signal, a failure signal, which indicates when there has elapsed a significant period of failure of threads being monitored. Each monitor also includes a red signal light 170 which is illuminated when there occurs a thread failure as indicated by comparator 116 (FIG. 2*b*) and a green signal light 172 which is illuminated when there is no failure or less than a significant period of failure of threads being monitored. During such period as there occurs a noted failure by comparator 116 and before the elapse of the minimum period, both lights will be illuminated, providing a combined orange or yellow glow.

Finally, the system includes an alarm and control circuit 87 which, responsive to run and failure signals from the two sensor monitors, effects a shutdown and alarm signal when there is a failed operation as indicated by either monitor. It further includes reset switches 241 and 260 and status red and green lights 288 and 290. It also provides conditional latching signals K to the individual sensors A and B and latching signal L to sensor monitors 47 and 85.

Figure 2A:
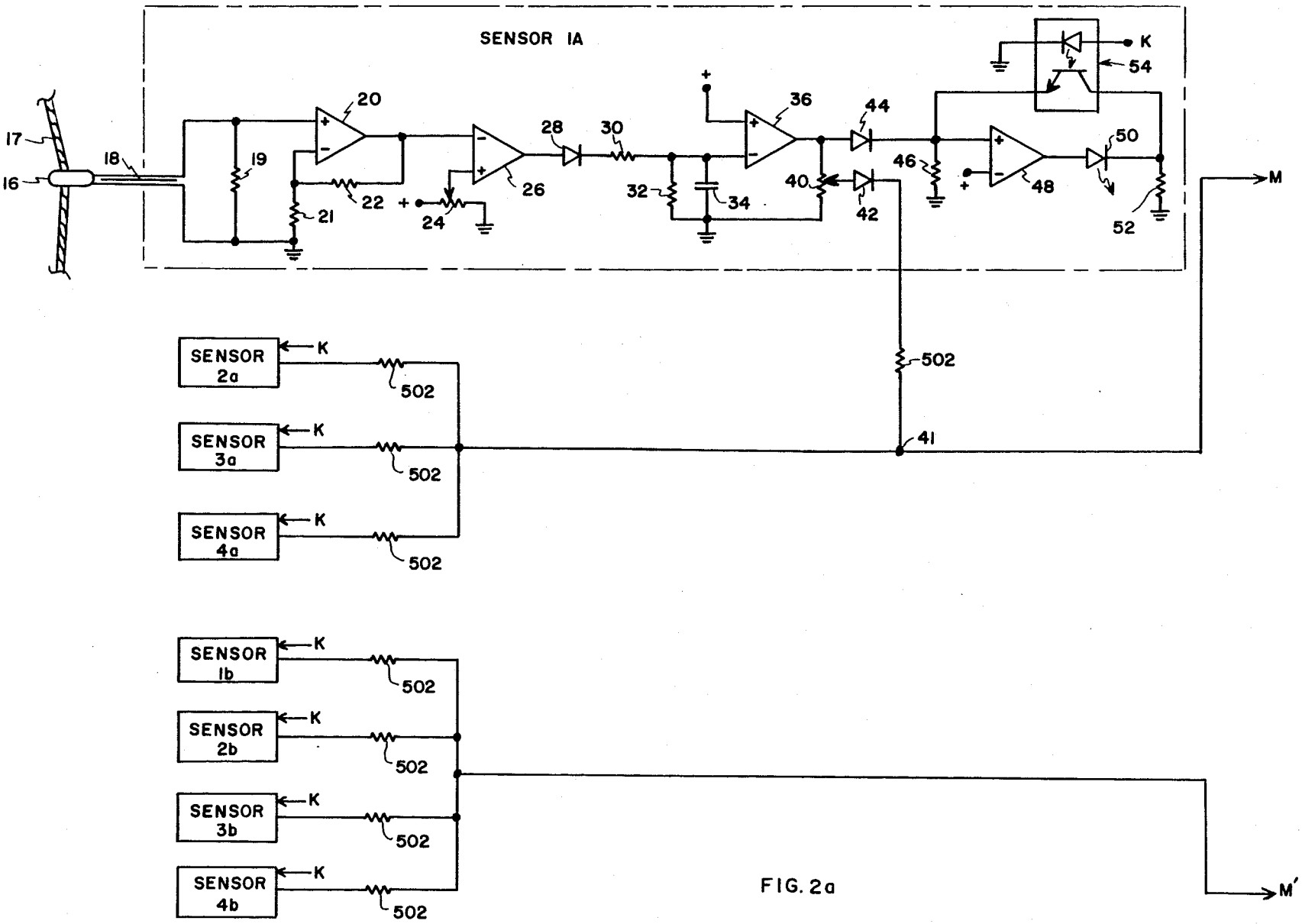
FIG. 2*a* is a partial combination block-schematic diagram more specifically illustrating the invention.
Figure 2B:
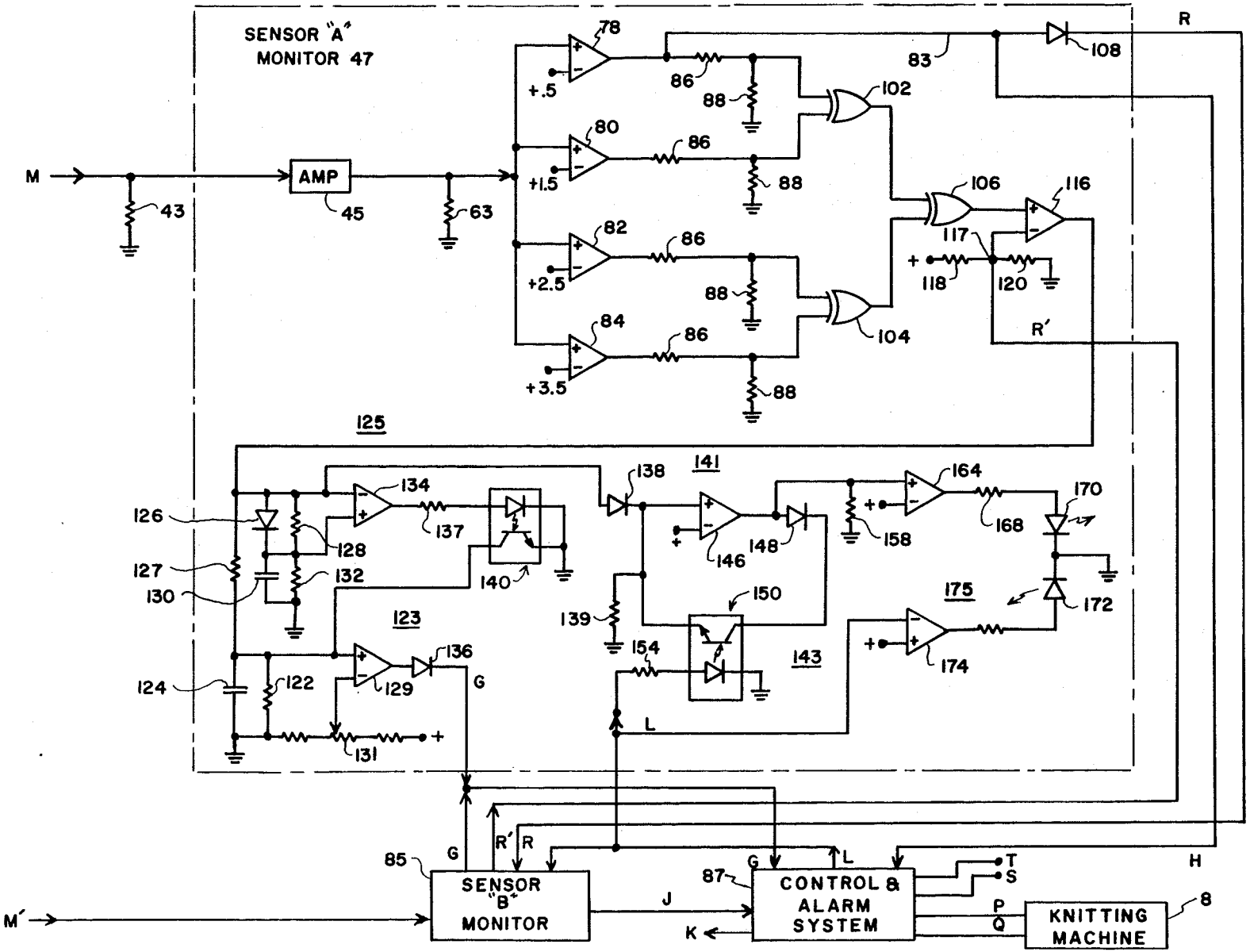
FIG. 2*b* is a continuation of FIG. 2*a*.

FIGS. 2*a* and 2*b* again illustrate the system of this invention but show in detail one of the sensor sub-systems and one of the sensor monitors, specifically, sensor 1A (FIG. 2*a*) and sensor A monitor 47 (FIG. 2*b*). The balance of the system is shown in block diagram form. Sensors 2A–4A and 1B–4B are identical to sensor 1A, and sensors B monitor 85 is identical with sensors monitor A 47. However, comparator reference voltages may differ.

Referring first to sensor 1A, it is provided a mechanical vibrational input via guide 16 which is in engagement with a thread 17. As long as thread 17 is moving against guide 16, guide 16 effects a vibrational output which is mechanically coupled to piezoelectric crystal 18. Crystals 18 then provides an A.C. output across resistor 19 and between ground and the non-inverting input of operational amplifier 20. A voltage divider circuit consisting of resistors 21 and 22 connected between the output of amplifier 20 and ground are connected to the inverting input and determine a selected gain for amplifier 20. The output of amplifier 20 is connected to the inverting input of operational amplifier 26, and a D.C. level for amplifier 26 is adjustably set by a positive bias being applied from potentiometer 24 to the non-inverting input of amplifier 26 and is externally adjustable by the user. Amplifier 26 and all amplifiers in the sensors are powered from a single positive D.C. bias, and thus all signal states at the outputs of the amplifiers are held in a range between 0 and a positive voltage.

The output of amplifier 26 is held high during periods when the output of amplifier 20 does not exceed the bias voltage applied to the non-inverting input of amplifier 26. The output is passed by diode 28 through resistor 30 across resistor 32 to the inverting input of operational amplifier 36. Capacitor 34 is connected across resistor 32 and between the inverting input and ground, the combination of these resistors and capacitor 34 in effect providing an integrator or low pass filter which, in view of the inverting effect of amplifier 26, is a voltage which decreases in value with an increase in time spent in low state (of amplifier 26) which is a function of amplitude and wavelength of the crystal signal and output of amplifier 20. A positive bias is applied to the non-inverting input of amplifier 36, with the result that there occurs at the output of amplifier 36 a D.C. voltage which is high or low (zero) indicating, respectively, a running state or non-running state. This voltage appears across potentiometer 40 connected between the output of amplifier 36 and ground. A current output of sensor unit 1A, and adjustable in amplitude by potentiometer 40, is fed via a diode 42 through a resistor 502 to a summing junction 41. Sensor units 2A, 3A, and 4A have a similar resistor 502 to provide a like output to summing junction 41. In this manner, there will appear a voltage at summing junction 41 which is proportional to the number of sensor units providing a thread-in-motion current output through resistor 43 (FIG. 2*b*), which may be the input impedance of an operational amplifier effecting a summation.

Each sensor unit, as shown in sensor unit 1A, further includes a properly running light indicator in the form of LED 50. To effect its operation, a second signal path exists from the output of amplifier 36 through diode 44 and across resistor 46 to the non-inverting input of operational amplifier, or comparator, 48. A positive reference voltage is applied to the inverting input of comparator 48, this voltage being one which is less than the signal input to the non-inverting input when a "normally running" signal is present. With a "normally running" signal present, the output of amplifier 36 goes high, and thus the output of comparator 48 goes high, powering LED indicator 50 and providing an output voltage across resistor 52. This output voltage appears across the phototransistor of optoisolator 54 and input resistor 46. Without the optoisolator being turned on, the resistance of the phototransistor will be high, and no significant voltage effect, positive feedback, will be impressed across resistor 46, and the condition just described with LED 50 illuminated will persist only as long as proper operation continues. However, in the event that the system determines a failure mode, the system of this invention provides for a latching voltage K to be applied to the LED of optoisolator 54, which then causes the phototransistor of the optoisolator to become a low resistance and the voltage across resistor 52 to be applied across resistor 46 and the non-inverting input of comparator 48, with the result that it will be held on, thus permitting an operator to examine the signal lights of all of the sensors and determine which were operating properly and which were not at the time of occurrence of a failure.

As stated above, the outputs of the sensor units monitoring one knitting operation are summed, thus the current outputs of sensor units 1*a*, 2*a*, 3*a*, and 4*a* are summed by summing amplifier 45 (FIG. 2*b*), this amplifier consisting of two serially arranged operational amplifiers and together provide a convenient-to-work-with voltage, being, for example, one volt with one working thread, two volts with two working threads, three volts with three working threads, and four volts with four working threads. This voltage is fed to circuitry which determines correctness or incorrectness of number of threads running. In this embodiment, that voltage is fed to a non-inverting input of comparators 78, 80, 82, and 84, with reference voltage of +0.5, +1.5, +2.5, and +3.5 being applied to the inverting inputs of these comparators, respectively. By this configuration, the output of all comparators will remain low until the signal input exceeds the reference voltage for a particular comparator. Thus, the output of comparator 78 will go high when one or more threads are sensed as being operative, comparator 80 when two or more are operative, comparator 82 when three or more are operative, and comparator 84 when four or more are operative. The fact that at least one thread is operative for a set of threads is thus indicated on lead 83 of each of sensors A and B monitors 47 and 85, and this indication, a high voltage, is fed to sensors B monitor 85 as signal R and as a like derived signal R′ from sensors monitor B to sensors monitor A. The outputs of each of the comparators are coupled to an exclusively OR logic element whereby a high state signal is generated when one thread is operated, and if one thread is operating, then the next must be operating. Similarly, if three threads are operating, there must be four threads operating. This is accomplished by applying the output of each comparator via a voltage divider consisting of resistors 86 and 88 to one input of an exclusively OR gate. Thus, the outputs of comparators 78 and 80 are applied to the inputs of exclusively OR gates 102, and the outputs of comparators 82 and 84 are applied to the inputs of exclusively OR gate 104. The outputs of these exclusively OR gates are applied to the inputs of exclusively OR gate 106. In this manner, the output of exclusively OR gate 106 will go high when there is either a one thread failure or a three thread failure. Thus, if X number are detected as running, logically there must be Y running for proper knitting to occur, where Y is greater than X and the number required to knit a discrete portion of an article.

In the example just described, it is assumed that a knitting machine is a four-thread knitter, and thus the four comparators are adapted to react to successive numbers of sensors as described. However, the four comparators may also be employed to effectively detect operation of knitters employing a greater number of threads, in which case, for example, the reference voltage applied to a final comparator would be a function of the highest number of threads being operated. Thus, for example, if there were eight, then the reference voltage would be 7.5 volts, or if 12, it would be 11.5 volts.

The output of exclusively OR gate 106 is fed to the non-inverting input of comparator 116 which is normally biased at terminal point 117 via a voltage divider consisting of resistors 118 and 120 to provide an approximately one volt input to the inverting input of comparator 116. Thus, in the event of a thread failure as described by a sensor being monitored by sensors A monitor, the output of exclusively OR gate 106 would go high, e.g., providing 2.5–5.0 volts, signalling this event and further driving comparator 116 high, said high signal being the indicator of failure detection to which all following circuitry responds.

In cases where more than one monitor is employed, an override of this signal (the output of comparator 116) may be provided for instances when there is a more basic systems problem (e.g., unwanted transient external vibration) which is not unique to either sensors monitor, as shown. This is the case where sensors for both threads A and threads B (FIG. 1) show falsely that A threads and B threads are both running. This condition is thus signalled only by control and alarm circuit 87 (FIG. 2*b*). Thus, to block an otherwise error signal output of comparator 116, the presence of dual run signals are cross coupled between sensors A and B monitors 47 and 85, being from the output of a comparator 78 of one monitor through diode 108 to a point 117 on the other monitor, being identified as signals or signal leads R and R′, respectively. Thus, for example, if sensors B monitor 85 indicates a thread or threads running, an approximately 10.5-volt signal is impressed at point 117 of sensors monitor A, and even though the non-inverting input of amplifier 116 might be driven with a "logical" high signal (4.0 volts rather than 0 volts) from preceding circuitry (in this embodiment the output of logic unit 106), indicating a single monitor problem, this output would be overcome by the cross coupled 10.5 voltage, and the output of comparator 116 would remain low, not signalling a thread problem. Instead, control and alarm circuit 87 (FIG. 3) would signal a general problem by turning on its red LED 288, as will be further described.

Figure 2C:
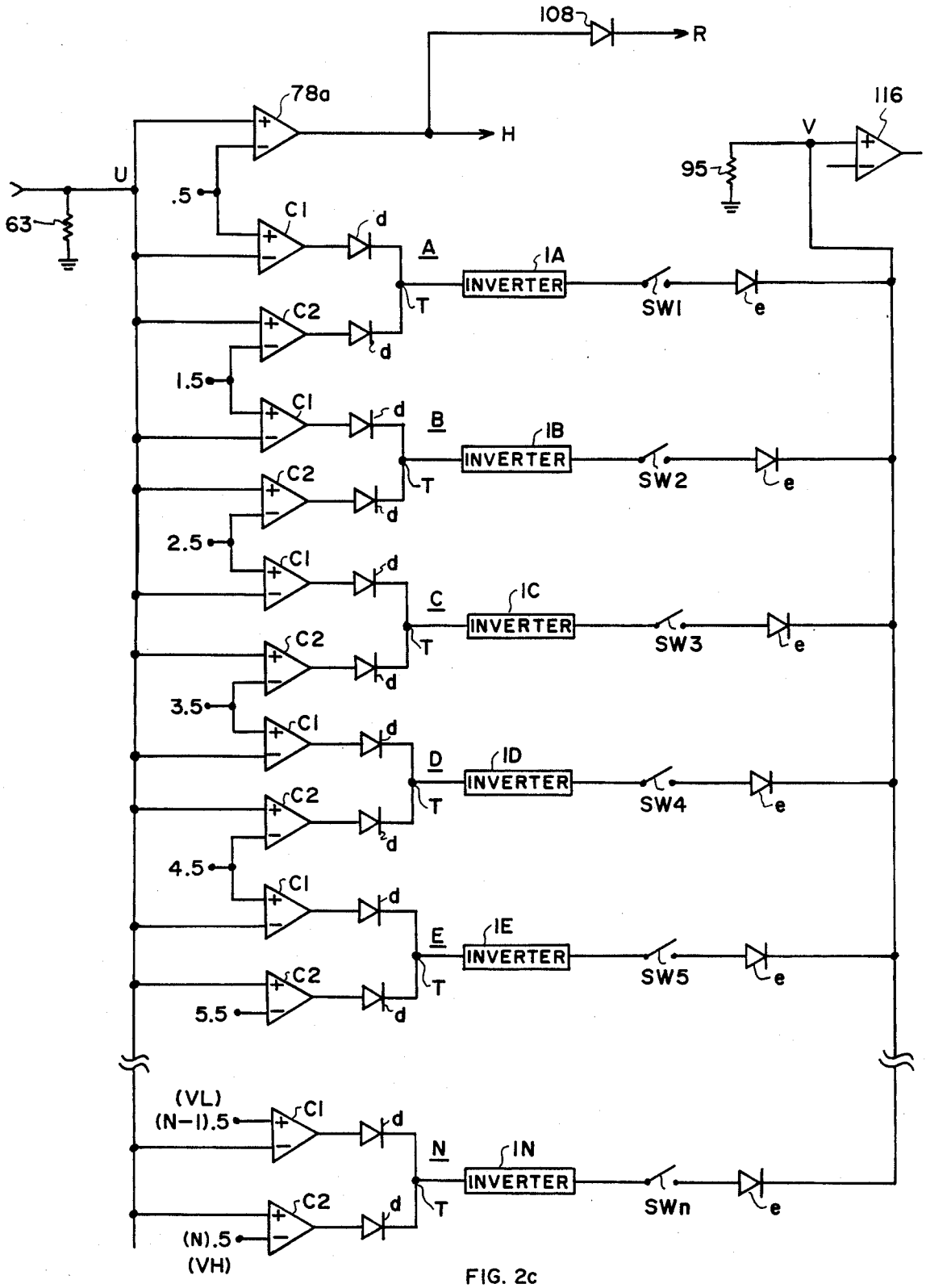
FIG. 2*c* is a schematic diagram of an alternate logic circuit to that shown in FIG. 2*b* for the determination of a thread failure state.

FIG. 2*c* illustrates an alternate arrangement to that shown in FIG. 2*b* for determining a signal upon the occurrence of a thread motion failure. It employs identical window comparators A–F and N, the latter designation indicating that there would be whatever selected number of these desired. Each senses when there is a discrete voltage, e.g., 1–5 and up to N volts, and when one occurs there is provided a low output on a terminal T of the corresponding window comparator. Each window comparator employs a set of comparators C1 and C2, with the non-inverting terminal of C1 being biased by a reference bias source which is at the low end of a selected range and the inverting input of C2 being biased by a reference voltage which is at the high end of that range, as shown. The inverting input of C1 and the non-inverting input of C2 are connected to common point U, the voltage appearing there being the voltage across resistor 63. Thus, as noted, each set of comparators is responsive to a differenct range, the first set being responsive to the range of 0.5 volts to 1.5 volts (one thread running), the second from 1.5 volts to 2.5 volts (two threads running), the third from 2.5 volts to 3.5 volts (three threads running), the fourth from 3.5 volts to 4.5 volts (four threads running), the fifth from 4.5 volts to 5.5 volts (four threads running), and the last one illustrated as being in a range of from a selected VL to a selected VH, the difference being the same 1.0 volt.

The outputs of all comparator pairs are connected through diodes D to a terminal point T. In operation, if there is a one thread state running, a 1.0 volt signal would be applied across resistor 63 to common point U, with the result that both comparators C1 and C2 of detector A would be low, providing a low voltage at a terminal T for that window comparator. This low voltage is inverted by inverter IA of the group labeled IA-IN. If it were desired to indicate a failure state if just one thread was running, switch SW1 would be closed of switches SW1-SWn, and the output of inverter IA applied through diode E and to common point V would go high. This voltage would appear across resistor 95 and at the non-inverting input of comparator 116 (the inverting input of which is biased in the manner shown in FIG. 2*b*), signaling that one thread, and only one thread, is running and that this has been selected as an error condition. As is to be noted, diode E is connected between each of switches SW1-SWn and common point V, thereby providing isolation between window comparators.

Thus from the foregoing, it is to be noted that we have established a rule that a switch would be closed when the number of threads running represented by it would be an incorrect number running. By this arrangement, any selection or combination of closed switches may be made as needed. For example, if it were determined that six threads running, four threads running, or two threads running were the only proper numbers, and that other numbers running would be improper, then, for example, switches SW1, SW3, SW5, and any switches numbered beyond 6 would be closed, as these would represent an improper number of threads running.

There has been added to this circuit an additional comparator 78*a* to thus provide the signals R and H as shown in FIG. 2*b* and as otherwise described in the specification.

To continue examination of sensors A monitor 47, we will next consider signal light control circuit 141 (FIG. 2*b*) which includes green LED signal light 172 and red LED signal light 170. Green signal light 172 is illuminated if no problems are detected by either of the sensor monitors. Red signal light 170 is illuminated in sensors A monitor 47 if that monitor detects a thread problem, and likewise, the red light 170 of sensors B monitor 85 will be illuminated if that monitor detects a problem. Further, if a problem is detected by either monitor, control and alarm circuit 87 will operate to turn off green lights 172 in both monitors.

To now examine the effect of the solely sensors A detected thread failure, the output of its comparator 116 will go high, and this signal will be fed through diode 138 to the non-inverting input of comparator 146, this being of a level higher than the reference input being applied to the inverting input. As a result, its output goes high across resistor 158, which output is applied to the non-inverting input of comparator 164. With a lower reference input being applied to the inverting input, the output of comparator 164 goes high, and this output is applied through resistor 168 across red LED signal light 170 to illuminate it as described, it signalling a thread failure with a thread A. Sensors A monitor 47, as well as its counterpart sensors B monitor 85, further includes latching circuitry 143 to latch on red light 170. It also includes circuit 175 to power green light 172, circuitry 143 and 175 being jointly controlled with like circuits in both monitors by a signal L from control and alarm circuit 87 which, when high, latches on comparator 146 and turns off green light 172, and when low, normally the case, holds on green light 172.

Latch signal L is developed by control and alarm circuit 87 responsive to an error signal from a high output of comparator 116 of either monitor, conditioned upon this output not being transitory, that is, instead staying on for a selected period. Such a condition is imposed by timing circuit 123 and timing delay circuit 125, which together develop a signal G when the conditions are met, which signal G is fed to control and alarm circuit 87 and is the basis of signal L. To examine the development of signal G, we will assume that the output of comparator 116 has gone high, indicating a thread failure sensed by monitor 47 (or 85). Experience has indicated that some signal bounce may occur and that a brief high state at the output of comparator 116 may be insufficient to label it as indicating a thread motion failure. Thus, means have been provided to delay recognition of an error state until this signal has stayed on for a selected period. Timing of the selected period is determined in circuit 123 by feeding the output signal of comparator 116 through an RC timing circuit consisting primarily of resistor 127 and capacitor 124, paralleled by discharge resistor 122. The capacitor voltage, as it rises with time, is fed to the non-inverting input of comparator 129. A potentiometer 131 enables the setting of a reference level on the inverting input of comparator 129 and thus determining the voltage to which the voltage on capacitor 124 must rise in time before there is a switching effect output of comparator 129 from a low to a high state, which then signals that a genuine failure has occurred, this being applied through diode 136 as signal G and to control and alarm circuit 87 as a shutdown signal.

It has been found, however, that circuit 123 alone is sometimes inadequate in that capacitor 124 may receive a charge from several oscillations on and off of the output of comparator 116 and thus not provide a good timing reference as to the continuous on or high time of the signal from comparator 116. Thus, it appears that in order to ensure that a sufficient continuous period of "on time" has occurred to be certain of a true breakdown, capacitor 124 is fully discharged before each timing cycle. To accomplish this, circuit 125 effects the discharge of capacitor 124 each time that the signal output of comparator 116 drops to zero. In examining circuit 125, it is to be noted that the signal output of comparator 116 is applied directly to the inverting input of operational amplifier 134 and that this output is applied through diode 126 to the non-inverting input of this amplifier, the non-inverting input being connected to ground through capacitor 130. A D.C. return resistor 128 is connected across diode 126, and a resistor 132 functioning as a discharge resistor for capacitor 130 is connected across the latter. With this circuit, should the output of comparator 116 rise and then fall before rising again to a stable condition (or for that matter, rise and fall several times before this occurs), the following effect is to be noted. When the input voltage rises, the voltage on the inverting input will be higher than on the non-inverting input by virtue of the voltage drop across the diode, with the result that amplifier 134 will be held off and there will be no output of amplifier 134. However, capacitor 130, which is charged during signal rise, retains a charge after the input signal falls and thereby, at least briefly, places a higher voltage on the non-inverting input than the inverting input, with the result that the output of amplifier 134 briefly goes high. When this occurs, there is current flow through resistor 137 and the LED of optoisolator 140, with the result that the phototransistor of the optoisolator turns on, grounding capacitor 124. In this manner, there is assurance that each time that the output of comparator 116 goes high, capacitor 124 would charge from a zero state, and thus the timing until it reaches a triggering state for comparator 129 is constant and thus that signal G, provided control and alarm circuit 87, is a reliable signal.

Signal G, as it occurs in either sensors A monitor 47 or sensors B monitor 85, is fed through resistor 184 (FIG. 3) and across a resistor 186 to the non-inverting input of operational amplifier 190 of control and alarm circuit 87. The inverting input is biased by a reference voltage 191 to a value of 5.5 volts, which cuts off amplifier 190 absent a signal G, or G'. A positive feedback resistor 188 connected between the output and non-inverting input latches amplifier 190 on with a high output state on the occurrence of a signal G or G', thus holding the state on after the removal of one of these signals. This latched signal is then employed in the provision of latch signals L and K. First, the latched signal output of amplifier 190 is applied to the non-inverting input of comparator 196, the inverting input being biased as in the case of amplifier 190. Comparator 196 thus repeats and buffers the output of amplifier 190. It drives the non-inverting inputs of comparators 202 and 204, which are otherwise biased for cut-off, that is, absent a high state from an output of comparator 196, bias being applied to their inverting inputs.

A latching signal L is obtained from the output of comparator 202, and an isolated signal K is obtained from circuitry connected to the output of comparator 204. Thus, as shown, the LED of optoisolator 208 is powered by a high output of comparator 204 through resistor 206. Thus, assuming there is a signal G or G' being present, the phototransistor of this optoisolator is then turned on, and its positive bias, as shown, is made available as signal K.

Latching signal L is supplied back to each of the sensors monitors 47 and 85, being fed through resistor 154 (FIG. 2*b*) to illuminate the LED of an optoisolator 150. This in turn lowers the resistance of the phototransistor of optoisolator 150; and if comparator 146 of a sensor member has been turned "on," this optoisolator supplies a regenerative path from the output of a comparator 146 through diode 148 and across input resistor 139 to the non-inverting input of comparator 146, latching such amplifier in the "on" state. As a result, red LED 170 of that sensor monitor would be held on.

At the same time, signal L is also fed to the inverting inputs of comparators 174 of each sensors monitor, and this would pull down the output of each comparator 174 to extinguish green light 172. Thus, the result would be that of the red and green lights in the two sensor monitors, the only light illuminated would be the red light, e.g., sensors monitor 47, a monitor sensing a lack of thread movement in one of the threads of the sensors it monitors. Both green lights would be turned off.

Latching signals K are used to lock on LED 50 (FIG. 1) in the sensors which were illuminated at the time of the occurrence of signal G, such effect being described above.

Figure 3:
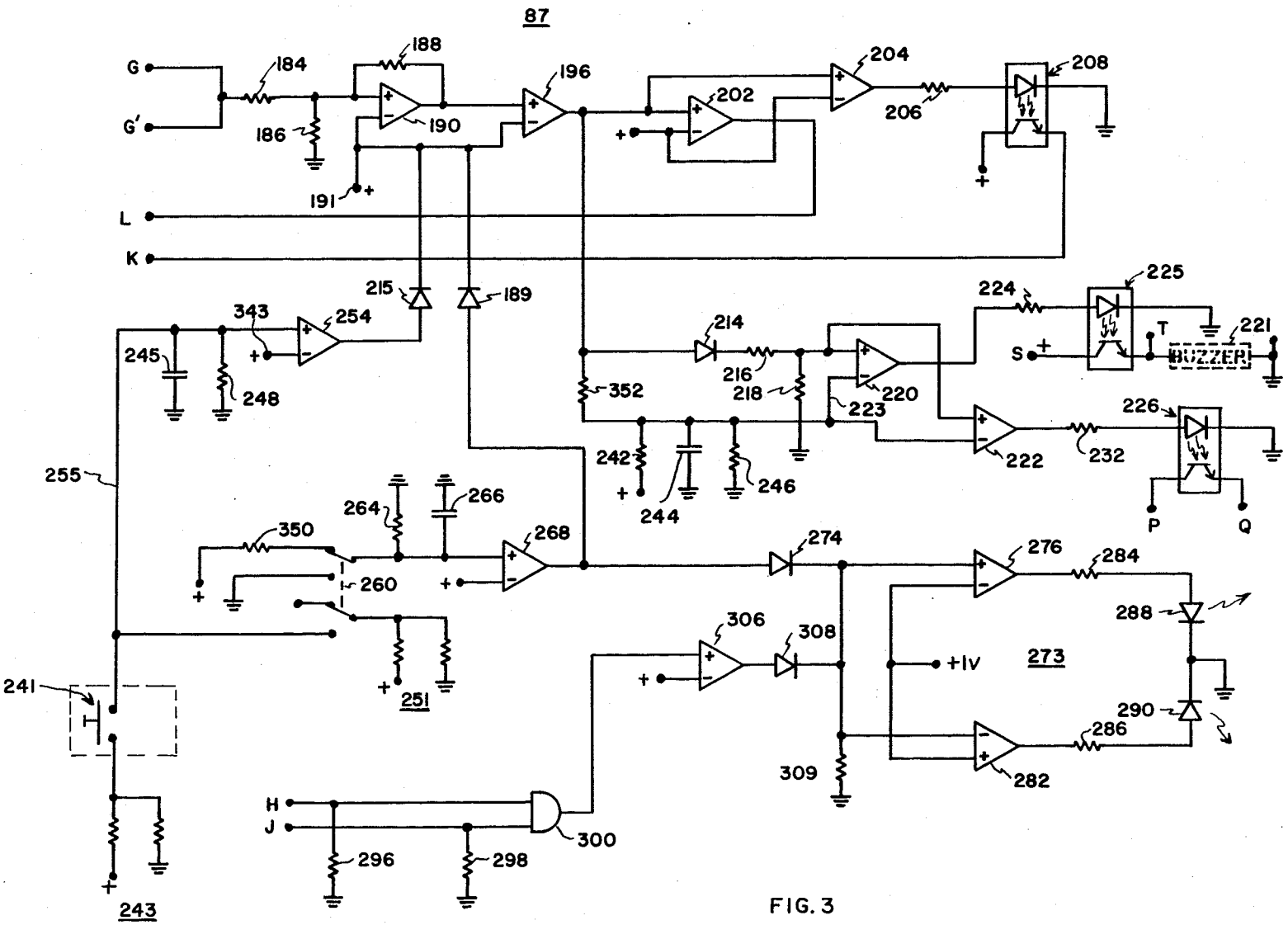
FIG. 3 is an electrical schematic diagram illustrating the control and alarm portion of the system.

A third function of control and alarm circuit 87 is to provide a signal circuit in the event of a high state G signal. Thus, the output of comparator 196 is supplied through diode 214 and resistor 216 to the non-inverting input of comparator 220 across resistor 218 and through resistor 352 and across capacitor 244 and resistor 246 to the inverting input of comparator 220. This input is thus a divided portion of the output of comparator 196, as will be explained. A reference voltage is also fed to lead 223 via a voltage divider consisting of resistors 242 and 246 which is fed to the inverting input of comparator 220. Absent a high signal from comparator 196, comparator 220 is held off. Pending a high state signal from comparator 196, the capacitor voltage of capacitor 244 is held to the reference voltage and holds comparator 220 off. Responsive to the output of comparator 196 going high, the resulting rising voltage is immediately applied to the non-inverting input of comparator 220, but because of capacitor 244, the rise is delayed to the inverting input while capacitor 244 is being charged. As a result, comparator 220 is immediately turned on and then off, the latter upon capacitor 244 becoming charged to a cutoff potential from the combination of the input signal and bias reference source. Thus, normally, capacitor 244 is biased by the positive source through resistor 242 and across what amounts to a summing resistor 246, in turn connected across capacitor 244. Thus, there occurs a pulse output of comparator 220, and it is applied through resistor 244 to the LED of optoisolator 225 to illuminate it. When this occurs, the resistance of the phototransistor of optoisolator 225 goes low, enabling an energizing potential to be applied to an external alarm circuit connectable across leads T and S. The alarm circuit may consist of, by way of example, a buzzer 221 as indicated in FIG. 3.

As a fourth function of control and alarm circuit 87, means are provided to externally control an electrical circuit such as a relay or other momentary circuitry of an external machine, such as in knitting machine 8, which would shut the machine down. Thus, the inputs applied to comparator 220 are in a like manner applied to comparator 222, and when its output is pulsed high, a high state signal appears through resistor 232 and turns on the LED of optoisolator 226. This effects a low resistance in the phototransistor of optoisolator 226 and switches "on" a conductive path between terminals P and Q.

Control and alarm circuit 87 also provides an operational signalling circuit 273 which functions in two ways. First, it signals via green and red LEDs 290 and 288 whether knitting is proceeding normally with one knitting operation or, in error, two knitting operations are falsely indicated. Thus, a signal H from the output of comparator 78 of monitor 47 (FIG. 2*b*) is applied across resistor 296 to one input of AND gate 300, and/or a signal J is simultaneously applied from comparator 78 of sensors monitor 85 across resistor 298 to the other input of AND gate 300. Properly, only one input should be high, and thus the output of AND gate 300 should normally be low. When this output is applied to the non-inverting input of comparator 306, together with a reference input which is applied to the inverting input of this comparator, the relative voltages in this case (with a low input to the non-inverting input) are such that the output of comparator 306 is low. If only a single monitor is employed, the output of AND gate 300 would remain low, as would the output of comparator 306. The output of comparator 306 is connected through diode 308 across resistor 309 to the non-inverting input of comparator 276 and the inverting input of comparator 282. A reference voltage of approximately 1 volt is then applied to the inverting input of comparator 276 and the non-inverting input of comparator 282. Assuming there are no other inputs to comparators 276 and 282, which will normally be the case, operational amplifier 276 will go low, and red LED 288 connected to the output of this comparator via resistor 284 will be held off. At the same time, the reverse will happen with respect to comparator 282, and its output will be high, and this high output will appear through resistor 286 to green LED 290, turning it on, indicating a normal state of operation. Conversely, if both signals J and H are high, indicating dual knitting operation, the signals will be reversed, and green LED 290 will be turned off and red LED 288 will be turned on.

Control and alarm circuit 87 also provides for the reset of the shutdown signals L and K. Actually, two reset controls are provided, one being via momentary single throw switch 241 and the other being via a momentary double throw switch 260 having a neutral center position.

To examine switch 241, an external switch in knitting machine 8, first, one of its leads is connected across voltage divider 243 to a reference bias, and the other lead is connected across capacitor 245 and discharge resistor 248 to the non-inverting input of comparator 254. Assuming now that a shutdown signalling state persists but the problem providing it has been corrected, by momentarily closing switch 241, a voltage is applied through the resistance of voltage divider 243 on lead 255 to the non-inverting input of comparator 254 and across capacitor 245. Upon release and the opening of switch 241, the time constant of the combination of capacitor 245 and resistor 248 is set to allow the voltage on the non-inverting input of comparator 254 to exceed reference input 343 applied on the inverting input for a period of a few seconds. For this period, the output of comparator 254 remains high and applies a high voltage state through diode 215 to the inverting inputs of comparators 190 and 196. This voltage is such as to exceed the shutdown voltage applied to the non-inverting inputs of these comparators, with the result that the output of comparator 190 is unlatched and goes low and the output of comparator 196 goes low, thereby producing a switching effect which causes comparators 202, 204, 220, and 222 to switch to a low state and thus removing the latch signals L and K to release the signal lights 50 (FIG. 1) in the sensors and to turn off red LED 170 (FIG. 2*b*) and to turn on green LED 172 in the sensors monitor which originally detected a thread problem and which it is now assumed has been corrected.

Alternately, switch 260 may be employed to effect reset. If the movable arms of this switch are moved downward, the lower set of contacts are engaged, and a current flow through a resistor of voltage divider 251 is fed to lead 255 and capacitor 245 in the same manner as by closure of switch 241, and the operation described for it is simply alternately achieved. If, on the other hand, the movable arms of switch 260 are raised, disabling is similarly achieved via charging capacitor 266 through resistor 350 which, at a selected voltage, triggers "on" comparator 268, otherwise held off by a reference voltage on the inverting input. Upon triggering, a voltage is applied through diode 189 to the inverting input of comparators 190 and 196 to effect a disabled state. A disabled state prevents signals G or G' from forcing operational amplifier 190 high. A disabled state is continuous during the capacitor discharging, this being typically for a relatively long period, e.g., five minutes. This allows the system to remain operative for such a period, for example, for test or for servicing purposes. Additionally, a disabled state is signalled by an "on" state of red LED 288 and an "off" state of green LED 290. Thus, when the output of comparator 268 goes high, a high voltage is applied through diode 274 on the non-inverting input of comparator 276 and the inverting input of comparator 282, thereby causing red LED 288 to turn "on" and green LED 290 to turn "off." When the arm of switch 260 is moved downward, capacitor 266 is immediately discharged, thereby terminating the disable function.

Figure 5:
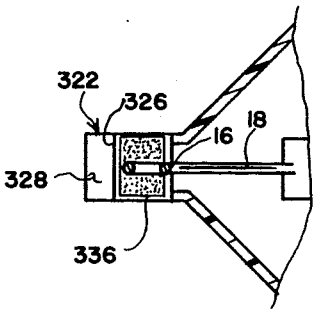
FIG. 5 is a sectional view taken along line 5—5 of FIG. 4.
Figure 4:
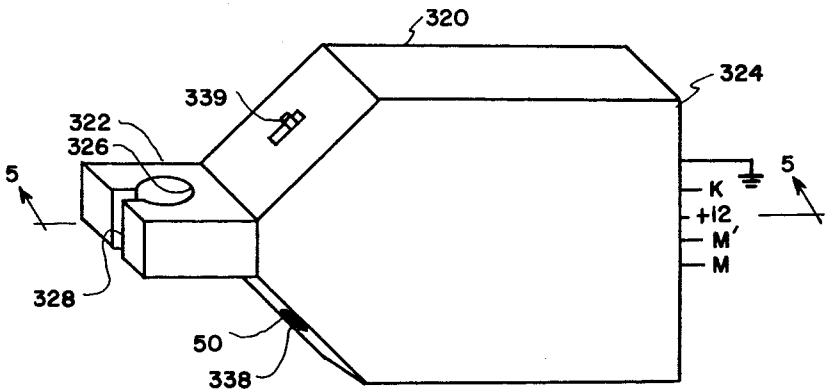
FIG. 4 is a pictorial view of the housing of the sensor schematically shown in FIG. 1.

A sensor is illustrated in FIGS. 4 and 5 and is shown to include a housing 320 having foward and rearward portions 322 and 324. An opening 326 is provided in forward portion 322 of housing 320 to enclose yarn guide 16. A slot 328 is disposed in communication with opening 326. Guide 16 is mounted in opening 326 and is a substantially annular ceramic member which is secured to one end of piezoelectric element 18. The other end of piezoelectric element 18 is secured to a support, which in turn is secured to housing 320. A resilient member 336 (FIG. 5) is provided in the forward portion 322 of the housing on the opposite sides of the ceramic member to resiliently mount the ceramic member in the housing. Signal light 50 is mounted in an opening 338 to indicate the operation state of the sensor as described above. A switch 339 is provided for switching the output between leads M and M' connected to monitors 47 and 85.

From the foregoing, it is to be appreciated that the applicants have provided a system of fault detection, indication, and control which is adapted to monitor discrete sets of thread movements and to relate them to indicate failure states, to provide a means of identifying a thread failure, and to actually control the on and off state of machinery utilizing discrete threads in typically some form of fabric generation.

We claim:

1. A system for monitoring motion of thread-like elements in their passage to an apparatus which combines said thread-like elements to produce a workpiece, said system comprising:

at least one set of sensors wherein each set comprises a plurality of sensors, each sensor disposed for generating one signal state responsive to motion of a said thread-like element and for providing a different signal state in the absence of any said motion;

coding means responsive to the outputs of a set of sensors for providing a condition signal which is a function of the number of like signal states present but independent of identity of discrete sensors detecting motion of thread-like elements;

detection means responsive to said condition signal for providing a significant signal which is an additive function of the level of said condition signal, whereby the presence or absence of a selected number of thread-like elements in motion is continuously indicated; and output means responsive to a said significant signal for indicating a failure of operation.

2. A system as set forth in claim 1 wherein said output means includes means for providing an electrical switching condition for the control of external circuitry.

3. A system as set forth in claim 1 wherein each said sensor includes indicating means for indicating a said signal state indicative of detected motion or detected non-motion, such indication not necessarily being indicative of a failure mode.

4. A system as set forth in claim 3 wherein each said sensor includes latching means responsive to a significant signal for latching said indicating means at its state at the time of appearance of said significant signal.

5. A system as set forth in claim 4 wherein said indicating means of a said sensor is operated on to indicate the presence of a said first signal state.

6. A system as set forth in claim 5 wherein a said sensor includes a housing having a piezoelectric crystal mounted therein for generating said first and second states, said housing having forward and rear portions, said forward portion having an opening therethrough to receive said thread-like material and a slot communicating into said opening for feeding said thread-like material therein.

7. A sensor as set forth in claim 6 including a ceramic member secured to said piezoelectric crystal for engagement by said thread-like member, said ceramic member having a central opening and slot therethrough disposed for coincident alignment with said opening and said slot of said housing, respectively.

8. A sensor as set forth in claim 7 including resilient mounting means mounted in said forward portion of said housing for resiliently mounting said ceramic member therein.

9. A sensor as set forth in claim 8 including means for mounting said indicating means therein, whereby said indicating means may be visually observed externally of said housing.

10. A system as set forth in claim 1 wherein a said coding means comprises means for providing as a said condition signal selected discrete voltages, each said voltage being an additive function of a discrete number of said thread-like elements in motion, and said detection means comprises means responsive to the presence of at least one of said discrete voltages for providing said significant signal.

11. A system for monitoring thread-like elements in their passage to an apparatus which combines said thread-like elements to produce a workpiece, said system comprising:

at least one sensor assembly comprising a plurality of sensors wherein each sensor is disposed for generating one signal state responsive to a said thread-like element passing thereby and for providing a different signal state in the absence of a passing of any said thread-like element;

at least one encoding means responsive to said sensors of a said sensor assembly for providing an encoded signal which is a function of the sum of the number of sensors providing said one signal state;

at least one monitor comprising:

at least three comparators, each having a first input coupled to said encoded signal and a reference input, and a discrete and different reference voltage coupled to each said comparator, being of a value which provides one output from a said comparator when a said first input to that comparator exceeds the reference voltage applied to that comparator and another output when said first input is less than said last-named reference voltage;

signal means responsive to the number of said comparators providing a like output for providing a failure signal; and output means responsive to said signal means of at least one monitor for signalling a failure condition responsive to a failure signal.

12. A system as set forth in claim 11 wherein said signal means of a monitor includes sustained failure detection means responsive to the appearance of said like outputs for a selected period for providing a said failure condition signal.

13. A system as set forth in claim 12 comprising a plurality of said monitors and wherein each said monitor includes means responsive to a said failure signal from any said monitor for providing a latched sustained indication of the occurrence of a failure upon the occurrence of a failure signal.

14. A system as set forth in claim 13 wherein a said sensor includes indication means for displaying a first state responsive to one of said signal states and a second state responsive to a said different signal state.

15. A system as set forth in claim 14 wherein each said sensor includes latching means responsive to a latching signal, in turn responsive to said failure condition signal from any said monitor for latching the display state of a said indication means.

16. A system as set forth in claim 15 further including reset means for selectively removing the latching of said display state.

17. A system as set forth in claim 15 further including reset means for disabling said latching means.

18. A system as set forth in claim 12 wherein said signal means includes switching means for providing a switching circuit responsive to a said failure signal.

19. A system as set forth in claim 18 further including means for disabling said switching means.

* * * * *